US006567057B1

(12) United States Patent
Sievenpiper et al.

(10) Patent No.: US 6,567,057 B1
(45) Date of Patent: May 20, 2003

(54) HI-Z (PHOTONIC BAND GAP ISOLATED) WIRE

(75) Inventors: Daniel Sievenpiper, Los Angeles, CA (US); Robin J. Harvey, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/659,392

(22) Filed: Sep. 11, 2000

(65) Prior Publication Data

(65)

(51) Int. Cl.[7] ..... H01Q 15/02

(52) U.S. Cl. ..... 343/909; 343/756

(58) Field of Search ..... 343/909, 755, 343/756, 700 MS, 840; 333/1, 218; 174/35

(56) References Cited

U.S. PATENT DOCUMENTS

| | | | | | |
|---|---|---|---|---|---|
| 3,961,333 | A | * | 6/1976 | Purinton | 343/872 |
| 4,905,014 | A | | 2/1990 | Gonzalez et al. | 343/909 |
| 4,970,634 | A | * | 11/1990 | Howell et al. | 362/342 |
| 5,519,408 | A | | 5/1996 | Schnetzer | 343/767 |
| 5,541,614 | A | | 7/1996 | Lam et al. | 343/792.5 |
| 5,675,299 | A | * | 10/1997 | Suski | 333/1 |
| 5,731,752 | A | * | 3/1998 | Wood | 333/218 |
| 5,923,303 | A | | 7/1999 | Schwengler et al. | 343/853 |

FOREIGN PATENT DOCUMENTS

| | | | |
|---|---|---|---|
| WO | 99/50929 | 10/1999 | H01Q/1/38 |

OTHER PUBLICATIONS

Balanis, C., "Aperture Antennas", *Antenna Theory, Analysis and Design*, 2nd Edition, New York, Chap. 12, pp. 575–597 (1997).

Balanis, C., "Microstrip Antennas", *Antenna Theory, Analysis and Design*, 2nd Edition, New York, Chap. 14, pp. 722–736 (1997).

Cognard, J., "Alignment of Nematic Liquid Crystals and Their Mixtures", *Mol. Cryst. Liq, Cryst.*, Suppl. 1, 1, pp. 1–74 (1982).

Doane, J.W., et al., "Field Controlled Light Scattering From Nematic Microdroplets", *Applied Physics Letters*, vol. 48, No. 4, pp. 269–271 (Jan. 27, 1986).

Jensen, M.A., et al., "EM Interaction of Handset Antennas and a Human in Personal Communications", *Proceedings of the IEEE*, vol. 83, No. 1, pp. 6–17 (Jan. 1995).

Jensen, M.A., et al., "Performance Analysis of Antennas for Hand–held Transceivers using FDTD", *IEEE Transactions on Antennas and Propagation*, vol. 42, No. 8, pp. 1106–1113 (Aug. 1994).

Ramo, S., et al., *Fields and Waves in Communication Electronics*, 3rd Edition, New York, Section 9.8–9.11, pp. 476–487.

Sievenpiper, D., et al., "High Impedance Electromagnetic Surfaces with a Forbidden Frequency Band", *IEEE Transactions on Microwave Theory and Techniques*, vol. 47, No. 11, pp. 2059–2074.

Sievenpiper, D., "High–Impedance Electromagnetic Surfaces", Ph.D. Dissertation, Dept. Of Electrical Engineering, University of California, Los Angeles, CA 1999.

Wu, S.T., et al., "High Birefringence and Wide Nematic Range Bis–tolane Liquid Crystals", *Applied Physics Letters* vol. 74, No. 5, pp. 344–346 (Jan. 18, 1999).

* cited by examiner

*Primary Examiner*—Hoang Nguyen
(74) *Attorney, Agent, or Firm*—Ladas & Parry

(57) ABSTRACT

A high impedance (Hi-Z) wire effectively transparent to electromagnetic radiation polarized in the direction of the wire, within an operating frequency band. The Hi-Z wire is sheathed with a thin layer of resonant structures that are small compared to the wavelength, and behave as a kind of photonic band gap (PBG) material. A frequency-selective polarizer comprising a plurality of Hi-Z wires disposed parallel to one other in a grid. A wire grid reflector that enables stepwise phase control of the reflected wave and focusing of radiative power, the reflector comprising Hi-Z wires interspersed with conventional wires disposed parallel to one another in a grid.

42 Claims, 11 Drawing Sheets

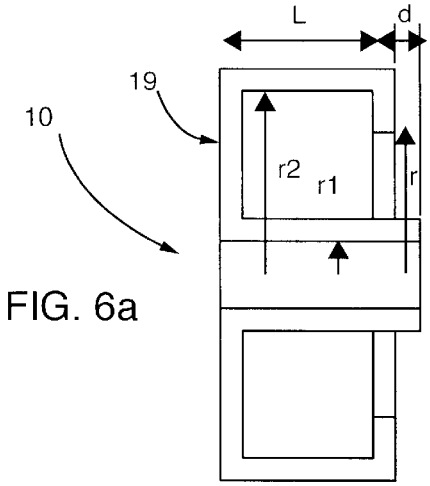
FIG. 6a
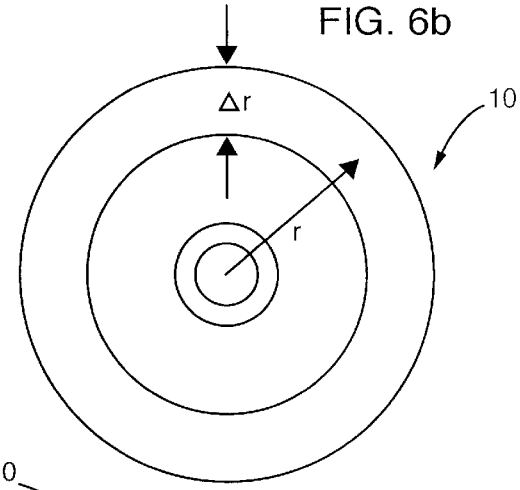
FIG. 6b
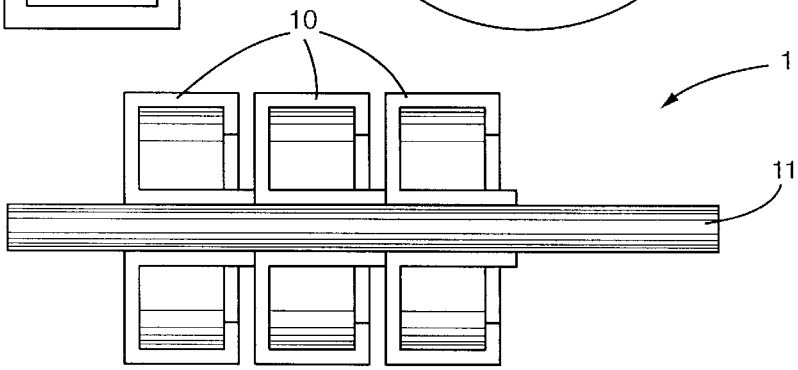
FIG. 6c
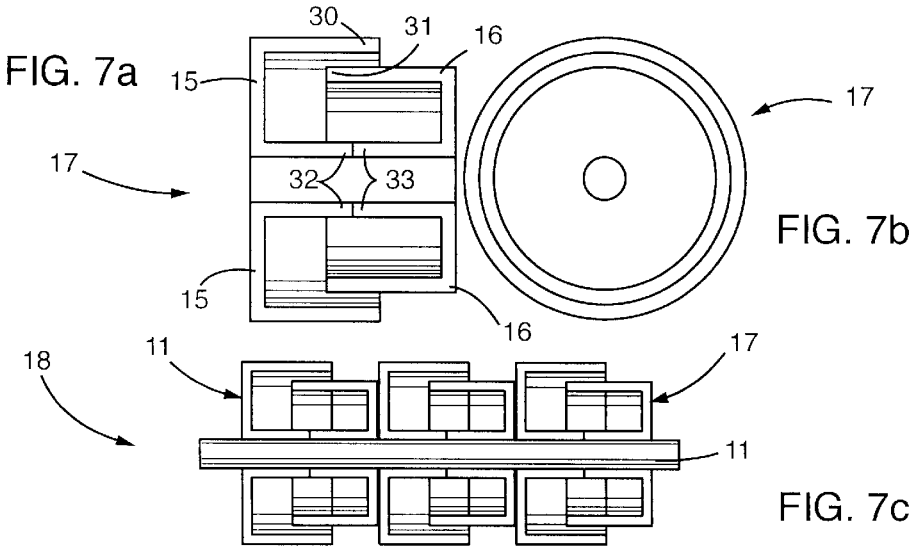
FIG. 7a
FIG. 7b
FIG. 7c Hi-Z Crimped Extrusion Sheathed Coaxial Cable Hi-Z Spiral Sheathed Coaxial Cable A) Extruded and Conformal Coated Spiral Screw B) Hi-Z Wire after swaging extruded and coated spiral screw

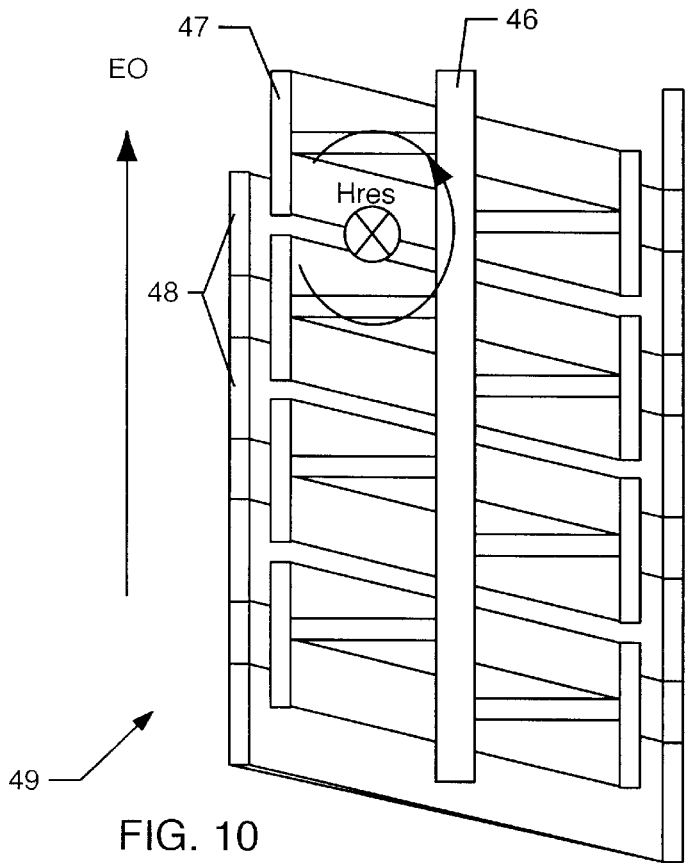
FIG. 10
FIG. 11a
PRIOR ART
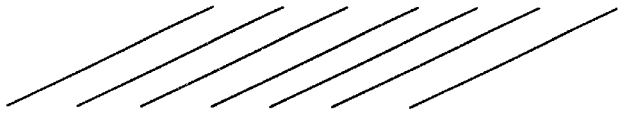
A) Conventional Wire Grid Polarizer
FIG. 11b
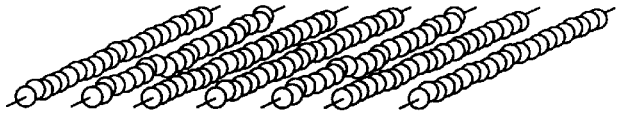
B) Band-selective Hi-Z Wire Grid Protector
FIG. 11c
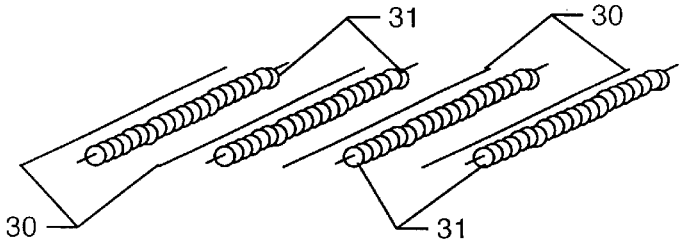
C) Low/Hi-Z Fresnel reflector for low grating lobes A) Above or below resonance B) At resonance

HI-Z (PHOTONIC BAND GAP ISOLATED) WIRE

TECHNICAL FIELD

This invention relates to a high impedance (Hi-Z) wire that is effectively transparent to radiation polarized in the direction of the wire, within an operating frequency band. The wire is sheathed with a thin layer of resonant structures, forming a photonic band gap (PBG) material. Out of band frequencies are reflected by the wire, frequencies within the operating band are unaffected. Such wires are more physically rigid than dielectrics and can be applied to non-interactive antenna support stays, dispersive polarizing beam splitters, or wire grid reflectors for focusing radiative power.

BACKGROUND OF THE INVENTION

The assembly of PBG materials has recently been advanced at UCLA (University of California at Los Angeles) using printed circuit board techniques to make a two dimensional array of sub-wavelength scale resonant structures on the surface of the board. These concepts are referred to in U.S. patent application Ser. No. 09/537,923 entitled "A Tunable Impedance Surface" filed on Mar. 29, 2000 and U.S. patent application Ser. No. 09/525,255 entitled "Radio Frequency Aperture" filed on Mar. 14, 2000.

A conventional high-impedance surface, shown in FIG. 1, consists of an array of metal top plates or elements 13 on a flat metal sheet 12. It can be fabricated using printed circuit board technology with the metal plates or elements 13 formed on a top or first surface of a printed circuit board and a solid conducting ground or back plane 12 formed on a bottom or second surface of the printed circuit board. Vertical connections are formed as metal plated vias 14 in the printed circuit board, which connect the elements 13 with the underlying ground plane 12. The metal members, comprising the top plates 13 and the vias 14, are arranged in a two-dimensional lattice of cells, and can be visualized as mushroom-shaped or thumbtack-shaped members protruding from the flat metal surface 12. The top plates or elements 13 are preferably hexagonal and the thickness of the structure, which is controlled by the thickness of the printed circuit board, is much less than one wavelength for the frequencies of interest. The sizes of the elements 13 are also kept less than one wavelength for the frequencies of interest. The printed circuit board is not shown for ease of illustration.

Turning to FIG. 2, the properties of this surface can be explained using an effective circuit model which is assigned a surface impedance equal to that of a parallel resonant LC circuit. The use of lumped circuit elements to describe electromagnetic structures is valid when the wavelength is much longer than the size of the individual features, as is the case here. When an electromagnetic wave interacts with the surface of FIG. 1, it causes charges to build up on the ends of the top metal plates 13. This process can be described as governed by an effective capacitance C. As the charges slosh back and forth, in response to a radio-frequency field, they flow around a long path P through the vias 14 and the bottom metal surface 12. Associated with these currents is a magnetic field, and thus an inductance L. The capacitance C is controlled by the proximity of the adjacent metal plates 13 while the inductance L is controlled by the thickness of the structure. The structure is inductive below the resonance and capacitive above resonance. Near the resonance frequency $$\omega = \frac{1}{\sqrt{LC}},$$

the structure exhibits high electromagnetic surface impedance. The tangential electric field at the surface is finite, while the tangential magnetic field is zero. Thus, electromagnetic waves are reflected without the phase reversal that occurs on a flat metal sheet. In general, the reflection phase can be 0, $\pi$, or anything in between, depending on the relationship between the test frequency and the resonance frequency of the structure. The reflection phase as a function of frequency, calculated using the effective medium model, is shown in FIG. 3. Far below resonance, it behaves like an ordinary metal surface, and reflects with a $\pi$ phase shift. Near resonance, where the surface impedance is high, the reflection phase crosses through zero. At higher frequencies, the phase approaches $-\pi$. The calculations are supported by the measured reflection phase, shown for an example structure in FIG. 4.

It would be useful for numerous applications if it were possible to cover or coat a wire with a Hi-Z surface, so that the wire would behave like a Hi-Z structure. However, the structure of the Hi-Z surface, as described in the prior art, does not lend itself to such covering or coating of a wire. The present invention overcomes this difficulty and provides techniques for disposing Hi-Z surfaces on wires. A technique for electrically isolating a wire by modifying its behavior from a low resistance short to a highly reactive current path is provided.

Metal guy wires, stays or struts are often the preferred construction technique for stiffening mountings and long posts; or for suspending objects away from walls or ceilings. For microwave applications, for example for mounting a detector horn at the focus of a parabolic reflector, metal parts can be added that will not interfere with the desired propagation of the electromagnetic signal. The supports no longer need to be a source of interference.

The prior art includes RF reflector and focal plane sensor systems. Typically, satellite antennas deploy a detector at the focus of an offset parabolic reflector, such as with DirecTV™ or DirecPC®. The parabola is offset for reasons that involve beam blockage and diffraction by the supports. This invention enables other construction techniques with better overall performance.

Baluns (typically ferrite beads with high magnetic permeability or balun transformer cores) are sometimes slipped over a wire to induce a high inductive reactance for a lead. In effect it is a low pass filter. High frequencies are reflected or absorbed by losses in the balun. Thus, generally the balun's effect is used for blocking out of a band noise. The present invention has low loss and the frequency of operation is more controllable than that which can be achieved with magnetic materials.

The Hi-Z wire of the present invention can be applied to microwave polarizers. One conventional method of producing a microwave polarizer is to use a layer of thin wires spaced less than a wavelength apart and aligned in the same direction, thereby forming a grid. An incoming electromagnetic wave will have its electric field component parallel to the wires reflected, and its component orthogonal to the wires undeflected by the grid. When Hi-Z wires (i.e., covered with a PBG medium) are used in the grid, the polarization effect is frequency dependent, which makes the polarizer band selective. This feature provides a useful improvement over conventional microwave polarizers.

Hi-Z wires can be used to construct a Low/Hi-Z Fresnel reflector which improves on traditional Fresnel reflectors. By using an array of wires with spacing on the order of ½ wavelength, one can reflect a wave to various angles similar to a conventional grating. However, this configuration has low efficiency due to the wide spacing of the wires. By placing Hi-Z wires between the ordinary wires, the efficiency is significantly improved. This is only possible with Hi-Z wires.

BRIEF DESCRIPTION OF THE INVENTION

In accordance with this invention, a metal wire is sheathed with a thin layer of resonant structures, forming a Hi-Z (high impedance) wire that is effectively transparent to radiation polarized in the direction of the wire within an operating frequency band. These structures are small compared to a wavelength and can be fabricated in mass production. Since the wire sheathing is effectively a photonic band gap layer, out of band frequencies will be reflected by the wire. Hi-Z wires are more rigid than dielectrics, and can be applied to non-interacting antenna support stays.

In another aspect of this invention, Hi-Z wires are disposed parallel to one another in a grid to form a frequency-selective microwave polarizer. Outside a certain frequency band, the electric field component parallel to the wires is reflected by the polarizer, whereas the orthogonal component passes through unaffected. Within a certain frequency band, the wires appear transparent to the radiation and no polarization occurs. The polarizing effect is thus frequency selective.

In yet another aspect of the invention, Hi-Z wires are interspersed with conventional wires and disposed in a grid to form a Fresnel reflector. This configuration enables stepwise phase control of the reflected phase.

In yet another aspect of this invention, a method of sheathing a wire with a thin layer of resonant structures is provided, as well as a method of polarizing electromagnetic radiation.

BRIEF DESCRIPTION OF THE DRAWINGS

FIGS. 6*a*, 6*b* and 6*c* depict a construction of the Hi-Z wire using C-shaped beads swaged on a wire;

FIGS. 7*a*,7*b* and 7*c* depict another construction of the Hi-Z wire using double-C-shaped beads swaged on a wire;

FIG. 10 illustrates a tunable Hi-Z wire wrapped with two spiral layers, one being fixed and the other sliding along the direction of the wire for varying the capacitance.

FIG. 11*a* depicts a conventional wire grid polarizer;

FIG. 11*b* shows a band-selective Hi-Z wire grid polarizer;

FIG. 11*c* illustrates a Low/Hi-Z Fresnel reflector for low grating lobes. The reflector is formed of alternating Hi-Z and conventional wires;

DETAILED DESCRIPTION OF THE INVENTION

Figure 1:
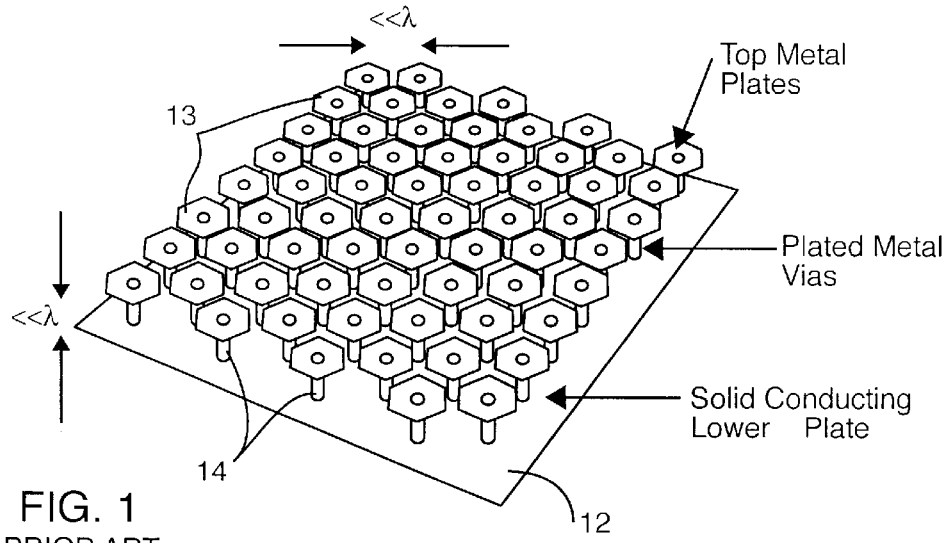
FIG. 1 PRIOR ART
FIG. 1 depicts a conventional high-impedance surface fabricated using printed circuit board technology of the type disclosed in U.S. Provisional Patent Ser. No. 60/079,953 and having metal plates on the top side connected through metal plated vias to a solid metal ground plane on the bottom side.
Figure 2:
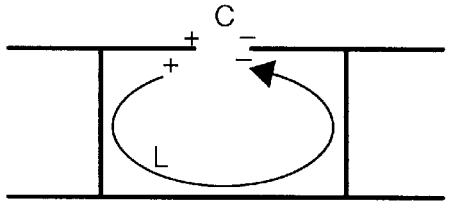
FIG. 2 PRIOR ART
FIG. 2 is a circuit equivalent of a pair of adjacent metal top plates and associated vias.
Figure 3:
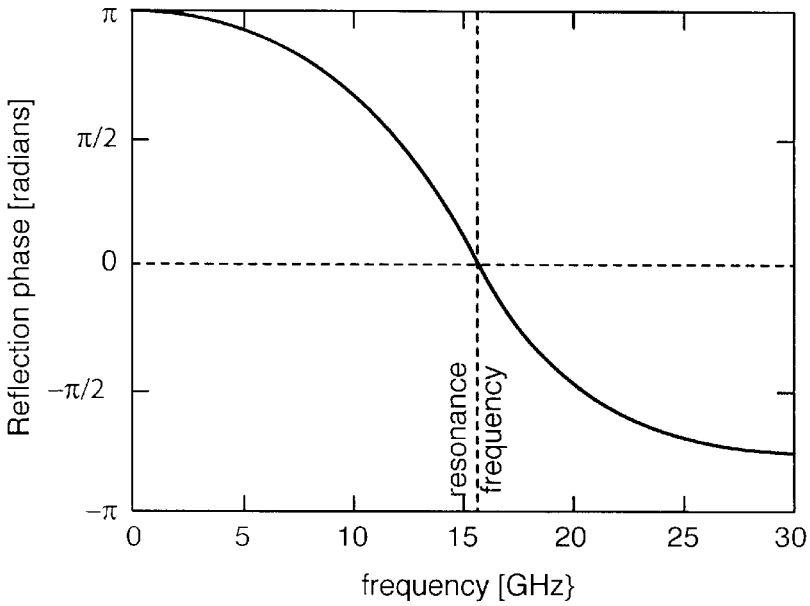
FIG. 3 PRIOR ART
FIG. 3 depicts the calculated reflection phase of the high-impedance surface of FIG. 1, obtained from the effective medium model and shows that the phase crosses through zero at the resonance frequency of the structure.
Figure 4:
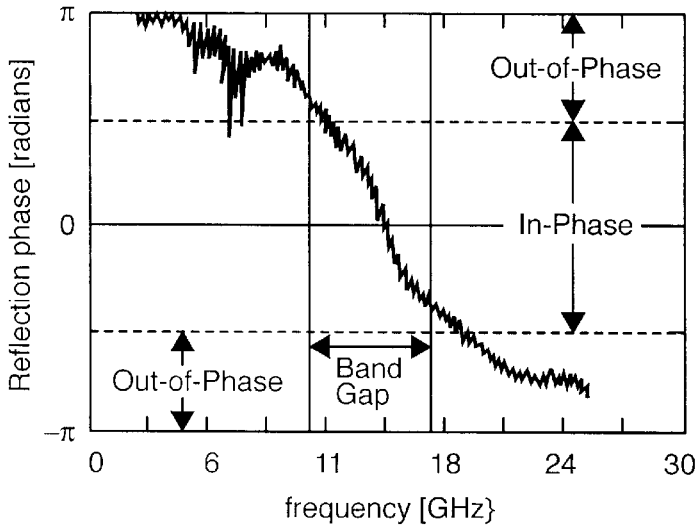
FIG. 4 PRIOR ART
FIG. 4 shows that the measured reflection phase agrees well with the calculated reflection phase.
Figure 5:
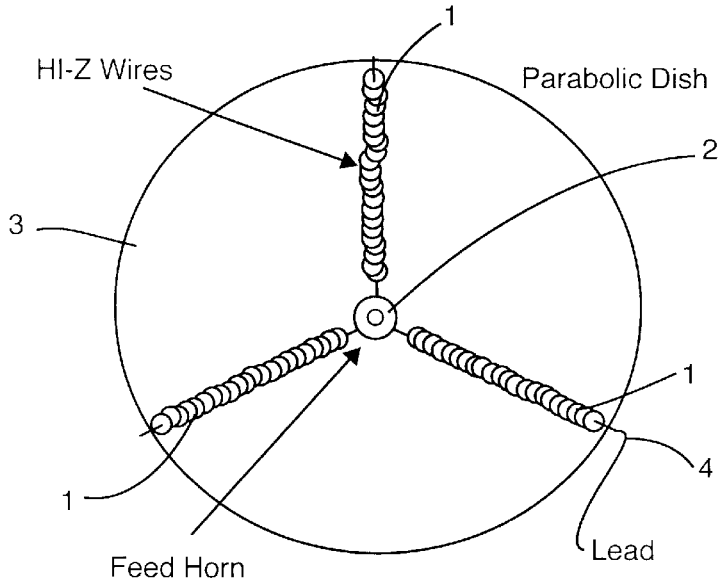
FIG. 5 shows a parabolic dish antenna the feed horn of which is mounted with Hi-Z wire supports.

FIG. 5 shows a possible application of the invention, where high impedance (Hi-Z) wires 1 are used to support the feed 2 of a conventional parabolic dish antenna 3. The use of Hi-Z wires 1 minimizes the unwanted interactions of the incoming electromagnetic field with the wires 1 which support the feed 2. A small diameter coaxial or fiber-optic lead 4 can be fabricated to run down the center of the Hi-Z wire 1, thereby isolating the lead from the incoming radiation.

FIGS. 6*a*, 6*b*, 6*c* show a possible construction of the Hi-Z wire 1, using C-shaped toroidal beads 10. More specifically, each bead consist of a toroid with a C-shaped cross section 19 as can be seen in FIG. 6*a*. A toroid is the surface defined by rotating a plane contour about an axis which lies in the same plane as the plane contour and which does not intersect the plane contour. In the particular case of FIG. 6, the plane contour has the shape of a C, which gives a C-shaped section to the toroidal bead. The beads 10 are preferably deep-die pressed out of a sheet metal which may include brass and/or copper, and threaded onto a wire 11. The resonance frequency that characterizes the transition from low to high impedance is determined by the resonance frequency of the cavity formed by the adjacent beads. The inductive component Lo is set by the ratio of the inner and outer radii r1 and r2 respectively of the cavity and the cavity length L, $Lo \sim \mu_0 L \log(r2/r1)$. The capacitance, C, is set by the area of the adjacent flange (area$\sim 2\pi r\Delta r$), and the spacing d between beads, $C \sim 2\pi\epsilon r\Delta r/d$. Consequently the transition frequency is near $\omega = 1/\sqrt{2\pi\epsilon\mu_0 L \log(r2/r1) r\Delta r/d}$. For the case where $r1 = \frac{1}{2}r2$, $r = \frac{3}{4}r2$, $\Delta r = \frac{1}{4}r$, $d = 0.1r$, $\epsilon = \epsilon_0$ and $L = r2$, we obtain:

$\omega = 5.2\ 10^7/r1$ rad/s and $r1/\lambda = 0.028$.

This confirms that the overall diameter of the Hi-Z wire, $D \sim 4\ r1 \sim 0.112\lambda$, can be made to be less than a tenth of a wavelength of the signal.

An alternative construction is shown in FIGS. 7*a*, 7*b*, 7*c*. The resonant cavity is composed of two over-lapping C-shaped beads 15 and 16, one bead 16 slightly smaller in diameter than the other bead 15. The inner rim 32 of the bead 15 is secured to the inner rim 33 of the bead 16, such that the open faces of the two beads face one another, thereby forming a double bead 17 as shown in FIG. 7*a*. Beads 15 and 16 need to be conductively attached to one another. This can be done by brazing-coating them with tin, assembling them, and heating them. The bead 16 having a diameter which is smaller than the bead 15, the outer rim 30 of bead 15 overlaps the outer rim 31 of bead 16, thereby defining opposing plates of a capacitor. The capacitance of the capacitor thus formed depends on the area of overlap and the distance between the plates. The double beads 17 are threaded onto the wire 11 to form the Hi-Z wire 18 as shown in FIG. 7*c*. Since the capacitance can be somewhat higher in this configuration, the relative diameter of the double beads 17 may be smaller than that of the single beads 10 shown in FIG. 6*a*.

There is an advantage to not having discontinuities in the conductive path: reliability and reproducibility are maximized by conductive connections. In order to improve the conductivity of the single bead type, the joints of the assembly can be soldered, or brazed, or a conductive adhesive may be used. The double-C form shown in FIGS. 7*a,b,c* has the advantage that the primary resonance path is within the cavity where there is only one joint. This joint may be pre-soldered, welded, or brazed before assembly of the double C shaped beads 17 onto the wire. Alternately, the double-C shaped beads 17 may be constructed in one piece by a double-step deep-forming process. A conformal dielectric coating may be added between rims 30 and 31 and/or throughout the interior of the bead to enhance the capacitance and insure isolation of the capacitive gaps. As in the single bead case, when assembled onto the wire 11, the double beads are preferably soldered or brazed in order to ensure a suitable conductive connection between the double beads.

Figure 8A:
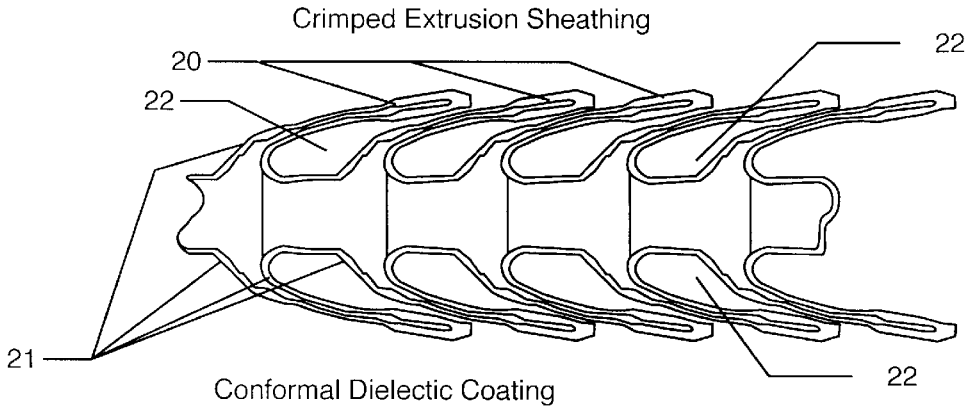
FIG. 8*a* is a cross-sectional view of the Hi-Z wire formed by a continuous extrusion and crimping method, and subsequent swaging of the extruded ribbed structures after conformal dielectric coating.
Figure 8B:
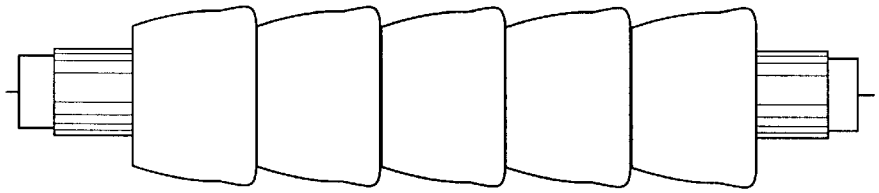
FIG. 8*b* is an external view of a coaxial cable sheathed with a Hi-Z layer according to the method of FIG. 8*a;*
Figure 8C:
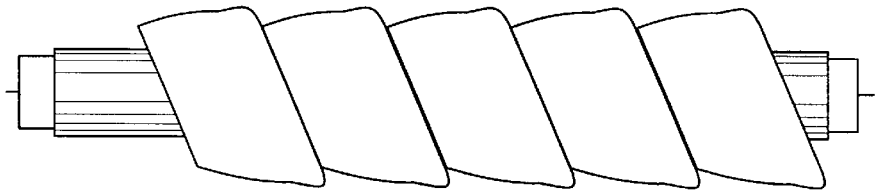
FIG. 8*c* is an external view of a coaxial cable sheathed with a Hi-Z layer by wrapping a continuous spiral strip around the cable.

Yet another embodiment is shown in FIGS. 8*a*, 8*b*, 8*c*. FIG. 8*a* shows resonant sheathing structures 22 that may be formed by a continuous extrusion and crimping method out of thin tubing or sheet metal. A metal tube with metal ribs 20, similar to a screw with very deep threads, is formed. The threads are coated with a conformal dielectric 21 , and then bent over so that they touch one another, with each layer lying on top of the next layer as shown in cross-section in FIG. 8*a*. FIG. 8*b* shows how the sheathing might look when applied to a coaxial cable. FIG. 8*c* shows a spiral sheathing that is folded as it is applied in a continuous process by a spiral forming machine (as is done with flexible aluminum dryer vent hose).

Other similar configurations can be formed and applied to wires, such as tape-like wrappings. The tape may be composed of metal/dielectric composite film which is wrapped around a wire.

Figure 9A:
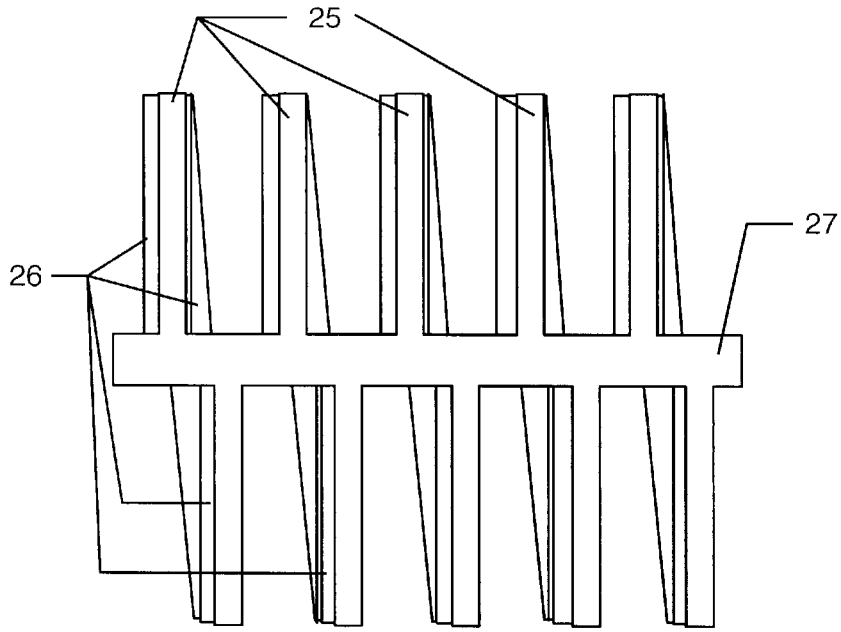
FIG. 9*a* illustrates the extrusion and crimping method applied to a spiral screw structure, before swaging of the extruded ribs, and after coating with a conformal dielectric.
Figure 9B:
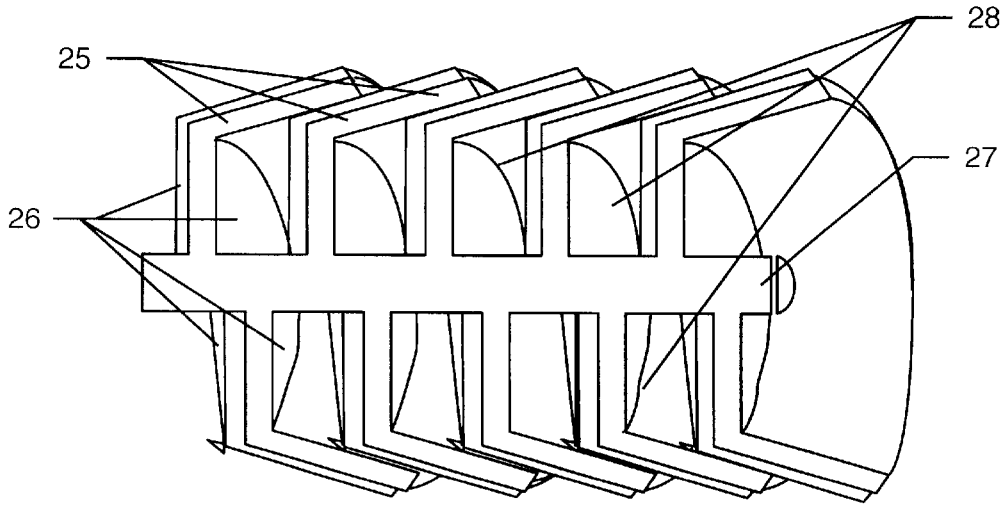
FIG. 9*b* shows the Hi-Z wire of FIG. 9*a*, after swaging of the extruded spiral ribs.

A preferred embodiment is to extrude the wire with twisted flat ribs 25 formed by a threading-like spiral surface wrapped around the core of the wire 27 as shown in FIG. 9*a*. A conformal dielectric coating 26 is applied to both sides of the ribs 25 which are then swaged as shown in FIG. 9*b*, to form the resonant cavities 28. Rigidity and strength of the wire are provided by the central core 27.

It is possible to construct variable overlaps in the capacitive parts of the C-shaped structures 10 and 17 shown in FIGS. 6*a*, 6*b*, 6*c* and 7*a*, 7*b*, 7*c*. For example, this can be realized by stringing the beads on two wires and fixing alternating elements to each wire, one of which is a sliding wire; or by introducing variable dielectrics with voltage control activated through the wires. In this manner, the resonance frequency of the cavity can be varied, and the phase shift of this tunable Hi-Z wire can be independently controlled. Thus, an incoming wave of fixed frequency can be reflected at a desired angle.

Turning to FIG. 10, an example of a construction of the tunable Hi-Z wire is shown. A first spiral layer 47 is wrapped around the core 46 of the wire 49. A second spiral layer 48 is wrapped around the first spiral layer 47 leaving a gap between the two spiral layers. A layer of dielectric can be introduced in the gap. The second spiral layer 48 can slide with respect to the first spiral layer 47, the first spiral layer 47 being fixed to the core 46 of the wire. By sliding the second spiral layer 48 along the direction of the wire, the area of overlap of the two spiral layers can be varied, and therefore the capacitance of the structure can be changed. Since the capacitance of the structure is directly related to its resonance frequency, this embodiment provides a Hi-Z wire having a tunable resonant frequency.

Figure 12A:
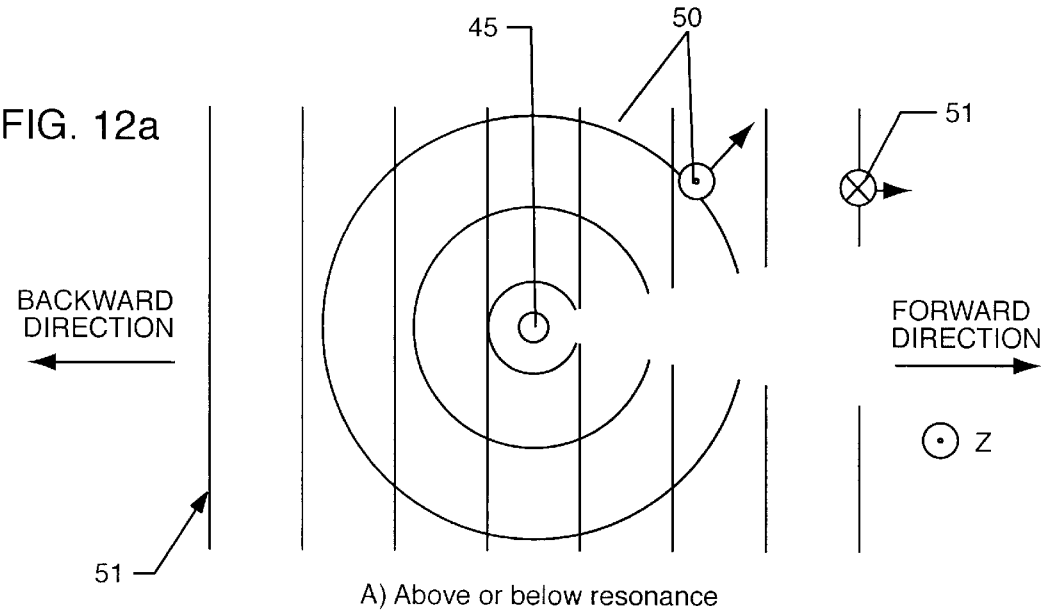
FIGS. 12*a* and 12*b* show the interaction of the Hi-Z wire with an incoming plane wave, at a frequency below or above resonance (FIG. 12*a*) and at the resonant frequency (FIG. 12*b*)
Figure 12B:
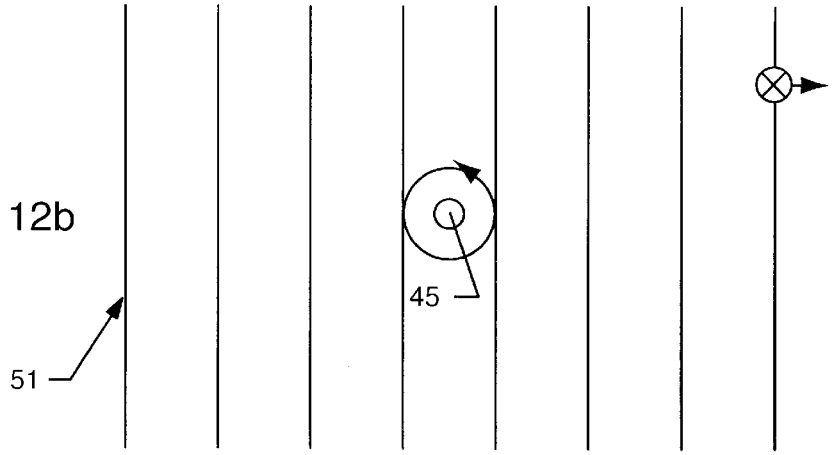

Below or above resonance, and as illustrated in FIG. 12*a*, the radiation 50 transmitted/reflected by the wire 45 is out of phase with the incoming signal 51. The radiation 50 emitted from the wire 45 is roughly cylindrically symmetric and polarized with the electric field in the Z direction. Scattered radiation in the forward direction tends to cancel the signal wave in the forward direction, and the net reflected wave will peak in the backward propagating direction, as shown in FIG. 12*a*. That is, the signal wave is back scattered as if the Hi-Z wire 45 were simply a solid wire. Thus, below or above resonance the Hi-Z wire 45 behaves like a simple wire.

As resonance is approached by increasing the frequency or tuning the Hi-Z wire, the wire current varies. The effective impedance of the wire exhibits a pole at the resonance frequency and its value goes to infinity. The wire current that couples to the signal wave then drops to zero, while its phase shifts by 90°. Consequently, the resonant field does not couple energetically to propagating waves, or scatter, and the wire appears transparent to the incoming wave 51. The incoming wave 51, passes through the wire unaffected.

Numerous structures and constructions thereof can be imagined and will certainly suggest themselves to a person skilled in the art. Accordingly, the embodiments presented herein are not meant to limit the scope of this invention.

FIGS. 11*a*, 11*b*, 11*c* show how the Hi-Z wire may be applied to polarization and to phase control in reflection. The conventional wire grid polarizer is shown in FIG. 11*a*. The electric field component aligned with the wire is reflected, and the component orthogonal to the wire passes through the grid unaffected. The same is true for the Hi-Z grid shown in FIG. 11*b*, when the frequency is below the resonance transition. However, at a higher frequency, the sign of the reflection coefficient reverses and the radiation is transmitted. Thus depending on the frequency, the radiation will pass through the grid unaffected or will be polarized by the grid. Such a polarizer, formed by a Hi-Z wire grid, is therefore frequency selective.

Figure 11D:
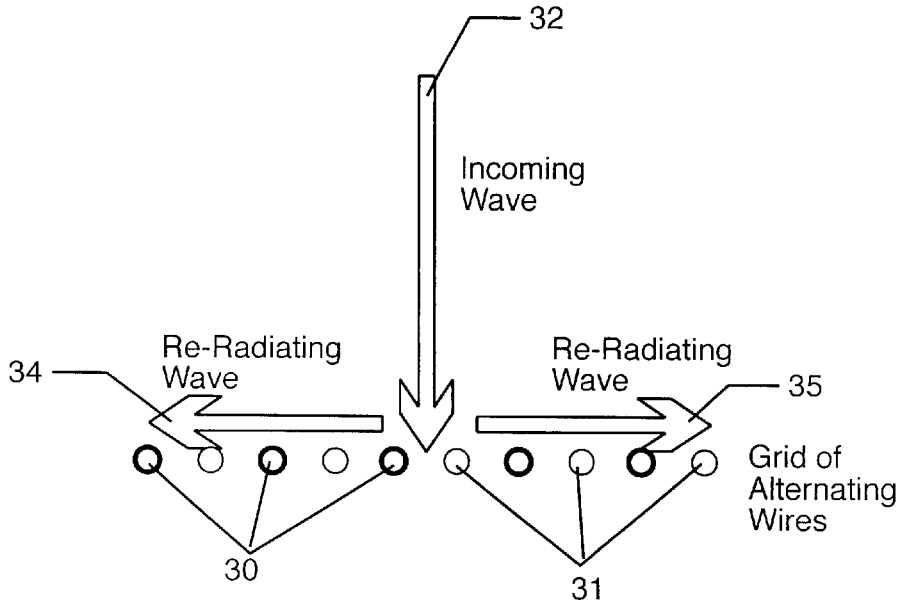
FIG. 11*d* depicts the interaction, at resonance, of an incident wave with the reflector of FIG. 11*c,*
Figure 11E:
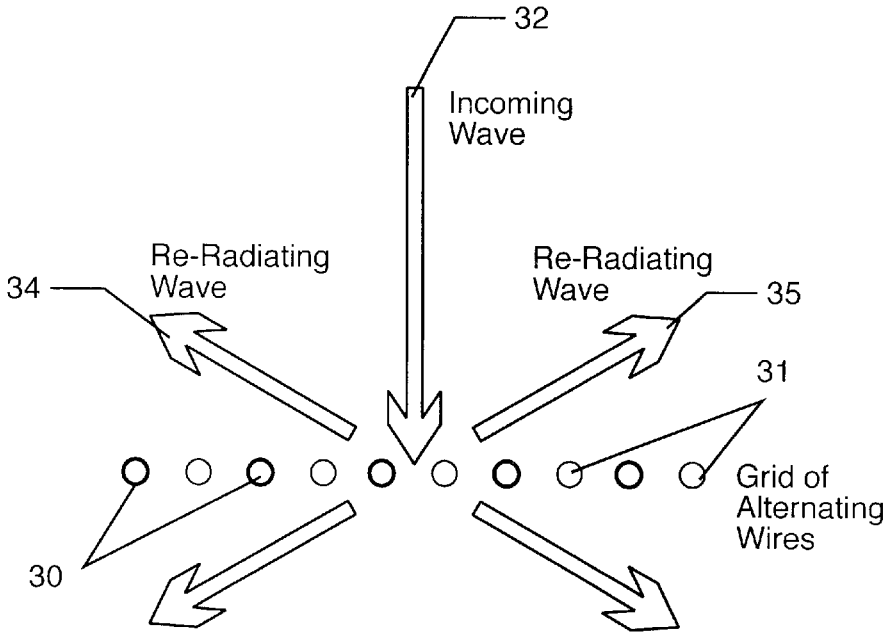
FIG. 11*e* shows how the reflection/transmission angle can be tuned by either tuning the frequency of the incident wave, or tuning the resonance frequency of the Hi-Z wires.

An alternative grid configuration is shown in FIG. 11*c*, where conventional wires 30 are interspersed with Hi-Z wires 31 to form a Low/Hi-Z wire grid reflector. If this one-dimensional grid is such that the wires are spaced one-half wavelength apart, with alternating wires having low and high impedance, the frequency of the incident radiation 32 being equal to the resonant frequency of the Hi-Z wires 31, then the grid will reflect radiation efficiently into two directions along the plane of the grid, the plane of the grid being orthogonal to the incident beam 32, as illustrated by FIG. 11*d*. This can be understood by recalling that the radiation in a particular direction can be calculated by adding up the radiation provided by the vector currents along all radiating surfaces. In the direction perpendicular to the plane of the grid, the currents on each alternating wire interfere destructively. In the direction along the grid, the currents on each wire interfere constructively. Since the Hi-Z wires 31 have an impedance which varies with frequency, the radiation angle can be tuned by either tuning the frequency of the incoming radiation 32, or by tuning the resonance frequency of the Hi-Z wires 31. FIG. 11*e* shows an example in which the Hi-Z wires have been tuned so as to set the reflection angle to a desired value. The radiation from each alternating wire will interfere constructively in a direction that depends on the impedance of the Hi-Z wires 31 and the frequency of the incoming wave 32. Thus, by tuning the frequency of the incoming wave 32, or by tuning the Hi-Z wires 31, one can steer the reflected beams 34, 35.

Figure 11F:
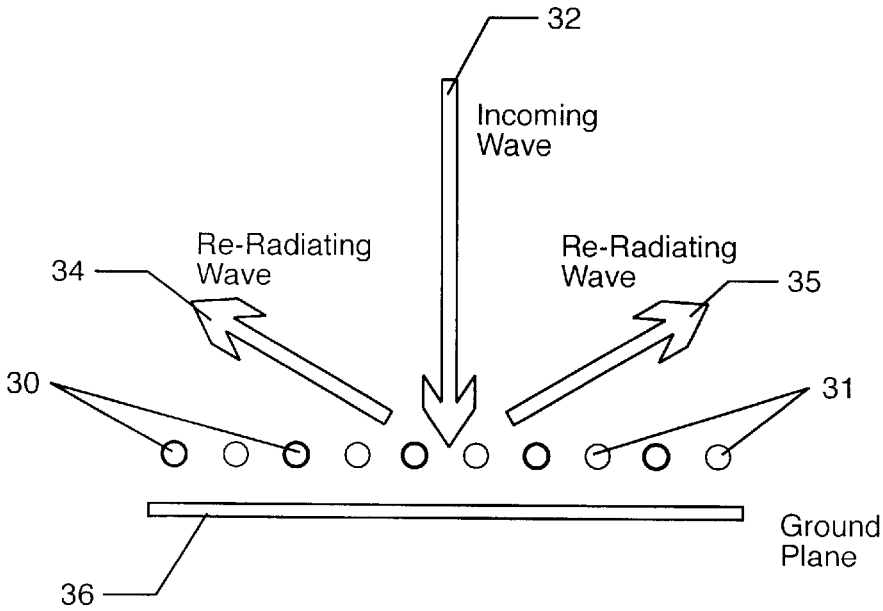
FIG. 11*f* shows the use of a ground plane with the reflector of FIG. 11*c*, which has the effect of eliminating the transmitted component of the wave.
Figure 11G:
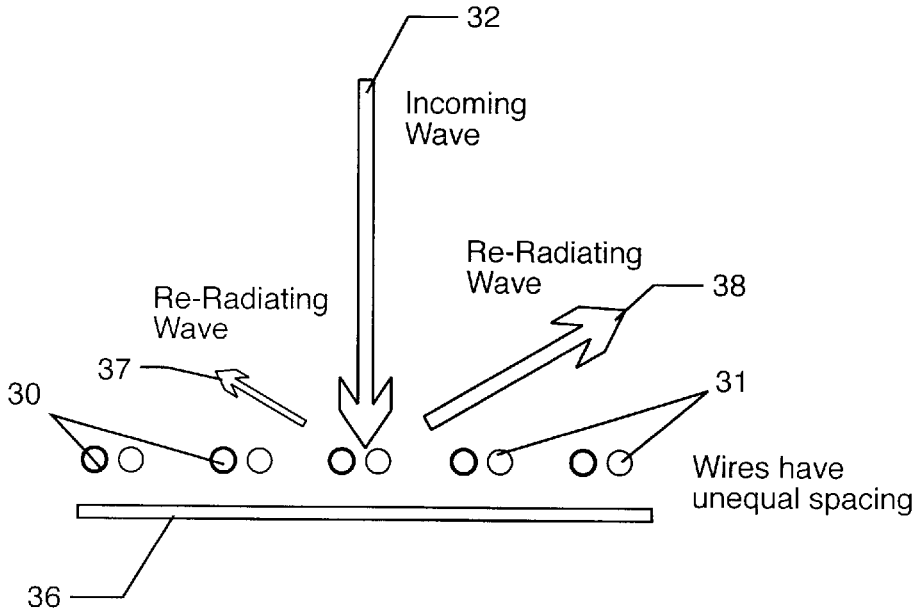
FIG. 11*g* illustrates how the incident wave can be mostly reflected in one preferred direction, by varying the spacing between the wires.

However, the surface will also radiate into the backward direction, since it is not entirely reflective. This problem may be solved by using a ground plane 36, as shown in FIG. 11*f*. The ground plane is preferably positioned about one-quarter wavelength below the grid of wires. One remaining problem is the formation of a second beam 34 into the opposite direction, away from the main beam 35. This may be solved by varying the spacing between the wires. FIG. 11*g* shows a grid in which the low impedance wires 30 and the Hi-Z wires 31 are grouped in pairs, each pair containing a low impedance wire 30 and a Hi-Z wire 31. In this example, the spacing between two adjacent pairs is greater than the spacing between two wires forming a pair. The spacing can be adjusted so that, for a particular impedance condition on the Hi-Z wires 31, the currents interfere constructively with the currents on the ordinary wires 30 in a particular direction to form a main beam 38, but interfere destructively in the opposite direction to form a weaker secondary beam 37. This is analogous to a blaze angle on an optical grating.

In a preferred embodiment of the Low/Hi-Z grid reflector, the wires are preferably attached to a rectangular or square frame made of a non-conductive material, the wires being disposed parallel to two sides of the frame.

As noted above, by appropriately tuning the resonance frequency of the individual wires forming the grid, a reflection phase gradient can be created across the array. This allows for one-dimensional steering of a beam in a direction contained in a plane which is perpendicular to both the plane containing the wires and the wires themselves. Additionally, if the resonance frequency of each wire is varied along the length of the wire, beam-steering can be realized in a direction contained in a plane which is perpendicular to the plane containing the wires and parallel to the wires. In this manner, two-dimensional beam-steering is achieved.

Figure 13A:
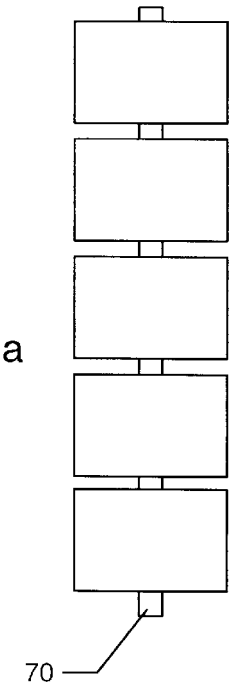
FIGS. 13*a* and 13*b* illustrate the structure of the Hi-Z wire which is the object the computer simulation depicted in FIG. 13*c;*
Figure 13B:
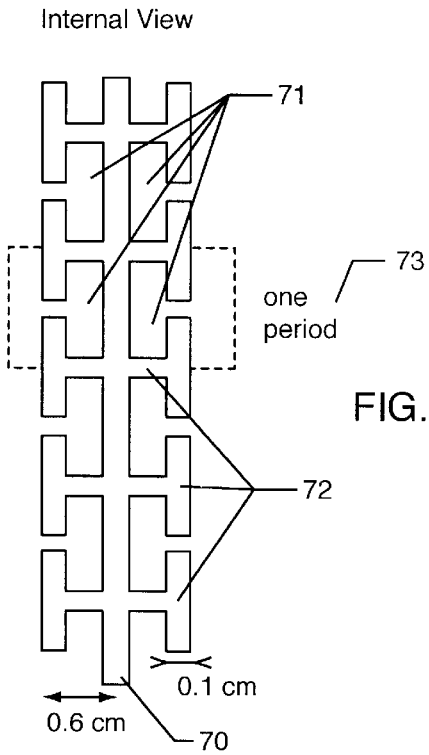
Figure 13C:
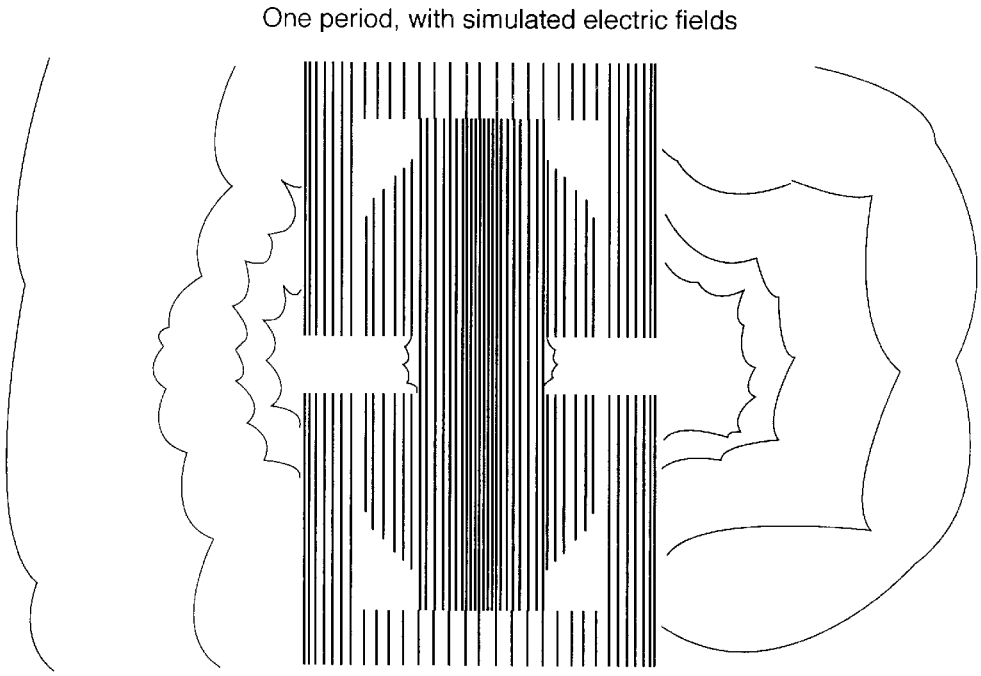
FIG. 13*c* shows one period of a simulated Hi-Z wire illuminated with a plane wave at a frequency near resonance. The small cavities in the wire support a mode which allows the plane wave to pass through the wire unaffected.

FIG. 13*c* shows a computer simulation of an embodiment of the Hi-Z wire shown in FIGS. 13*a* and 13*b*. By way of this example, the concepts associated with the present invention are demonstrated. The structure modeled is a straight wire 70 loaded with external cavities 71. The cavities 71 consist of an outer metallic sheath around the wire. Periodic breaks are present in the sheath which define the locations of the individual cavities 71. Between the breaks the sheath is shorted to the inner wire through the connections 72. One period 73 of this structure was modeled using HFSS, a commercially available finite element modeling package available from Agilent. For the purpose of simulation, the structure is placed in a so-called "TEM waveguide" consisting of electric walls on two sides and magnetic walls on the other two sides. This geometry simulates a infinite array of such structures being irradiated by plane waves at normal incidence.

Figure 14A:
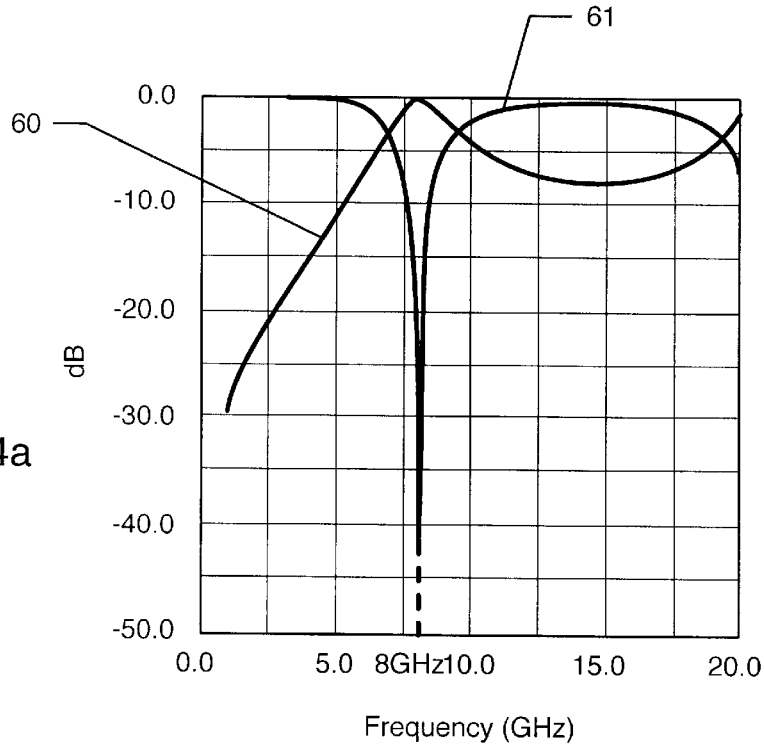
FIG. 14*a* is a graph showing the magnitude of the reflected and transmitted electric field as a function of frequency during the simulation of FIG. 13. The reflection magnitude goes to zero near resonance where the wire appears transparent.

The inner wire 70 is 0.2 cm in diameter, the outer part of the sheath is 0.1 cm thick and 0.6 cm in diameter. The narrow gap forming the capacitive part of the cavity is 0.1 cm wide. The structure is illustrated in FIGS. 13*a* and 13*b*. FIG. 13*c* shows the magnitude of the electric field at 10 GHz. The structure has a resonance frequency of about 8 GHz, which can be seen in the transmission 60 and reflection 61 plots of FIG. 14*a*. At the resonance frequency, the reflection drops and the transmission reaches 100%.

At the resonance frequency of 8 GHz, the free-space wavelength is 3.75 cm. The diameter of the wire is only 0.6 cm, which is less than the one-half wavelength thickness that would normally be expected. This is due to capacitive loading of the cavity, and is analogous to what is routinely achieved with Hi-Z surfaces. The diameter could be lowered further by overlapping the metal plates, using one of the methods described above.

Figure 14B:
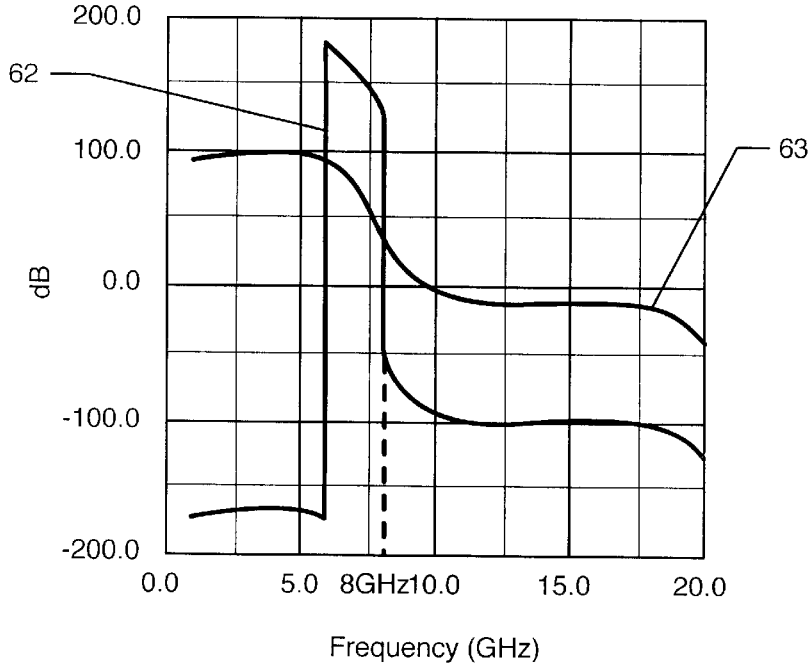
FIG. 14*b* is a graph showing the phase of the reflected and transmitted electric field as a function of frequency during the simulation of FIG. 13. The transmission magnitude crosses through zero at resonance where the wire appears transparent.

The phase of the transmitted 63 and reflected 62 signals are shown in FIG. 14*b*. The sudden jumps in the reflection phase are due to the ambiguity of inverse trigonometric functions, and are an artifact of the simulation method. The important feature to note is that the transmission phase crosses through zero near the resonance frequency, as expected. The slight shift toward higher frequencies is related to the non-zero radius of the wire.

This simulation confirms that structures of the type presented here can appear transparent to electromagnetic waves near their designed resonance frequency, even though they have a core of solid metal.

Having described the invention in connection with certain embodiments thereof, modifications will certainly suggest themselves to those skilled in the art. As such, the invention is not to be limited to the disclosed embodiments except as required by the appended claims.

What is claimed is:

1. A conductive wire essentially transparent to electromagnetic radiation having a frequency lying within a certain frequency band.

2. The wire of claim 1, wherein an outer surface of the wire comprises a layer of photonic band gap material.

3. The wire of claim 1, wherein an outer surface of the wire comprises a layer of resonant structures, the resonant structures having a resonance frequency near the frequency of the electromagnetic radiation.

4. The wire of claim 3, wherein the resonant structures each comprise a resonant cavity, the resonant structures having a capacitance and an inductance.

5. The wire of claim 4, wherein the resonant structures comprise:

(a) continuously extruded and crimped expanded ribs, the expanded ribs being coated with a dielectric;

(b) folded expanded ribs along the length of the wire, thereby forming the resonant cavities.

6. The wire of claim 5 wherein, before folding, the expanded ribs comprise discs centered on an axis of the wire.

7. The wire of claim 4, wherein the resonant structures are formed by:

(a) extrusion of the wire with twisted flat ribs forming a spiral surface wrapped around the wire in a threading-like fashion;

(b) swaging of a portion of the flat ribs to thereby form the resonant cavities.

8. The wire of claim 7, wherein the spiral surface is coated with a dielectric.

9. The wire of claim 3, wherein the resonant structures comprise beads that are disposed around the core of the wire.

10. The wire of claim 9, wherein the beads each have a resonant cavity, the beads having a capacitance and an inductance.

11. The wire of claim 10, wherein the beads each consist of a toroid with a C-shaped section, the toroid being defined by rotating a C-shaped plane contour about an axis that lies in the same plane as said contour, said axis not intersecting said contour; said resonant cavity lying within an inner surface of the toroid, said capacitance being formed by opposing surfaces of adjacent beads.

12. The wire of claim 11, wherein the toroids are deep-die pressed out of sheet metal.

13. The wire of claim 12, wherein the sheet metal includes brass and/or copper.

14. The wire of claim 10, wherein the beads each consist of a first toroid having a C-shaped section and a second toroid also having a C-shaped section, each toroid being defined by rotating a C-shaped plane contour about an axis that lies in the same plane as said contour, said axis not intersecting said contour, the second C-shaped section being smaller than the first C-shaped section, an inner rim of the first toroid being secured to an inner rim the second toroid, such that an open side of the first toroid faces an open side of the second toroid, an outer rim of the first toroid overlapping an outer rim of the second toroid, leaving a gap between the two overlapping outer rims, thereby forming two opposing plates of a capacitor having said capacitance; the resonant cavity lying within an inner surface of the beads.

15. The wire of claim 14, wherein the toroids are deep-die pressed out of sheet metal.

16. The wire of claim 15, wherein the sheet metal includes brass and/or copper.

17. The wire of claim 3, wherein a dielectric is disposed on at least part of a surface of the resonant structures.

18. The wire of claim 3, wherein the resonance frequency can be tuned.

19. The wire of claim 18, wherein the wire consists of a metallic spiral spring, the resonance frequency of which can be tuned by compression or extension of the metallic spiral spring.

20. The wire of claim 18, comprising:

(a) a first spiral layer wrapped around a core of the wire;

(b) a second spiral layer wrapped around the first spiral layer slidably;

(c) a dielectric disposed between the first and second spiral layers; the resonance frequency of the wire being tuned by sliding the second spiral layer relative to the first spiral layer, thereby varying an area of overlap of the two spiral layers and changing a capacitance associated with the wire.

21. The conductive wire of claim 1 wherein the wire is essentially transparent to electromagnetic radiation having said frequency lying within said certain frequency band in that the wire exhibits a reflection at said frequency which is at least 20 db below reflections outside said certain frequency band.

22. A band-selective polarizer comprising a plurality of wires disposed substantially parallel to one another in a grid, the wires being essentially transparent to electromagnetic radiation having a frequency lying within a certain frequency band.

23. The polarizer of claim 22, wherein an outer surface of each wire comprises a layer of photonic band gap material.

24. The polarizer of claim 23, wherein the outer surface of each wire comprises a layer of resonant structures.

25. A method of making a wire essentially transparent to an electromagnetic radiation, the electromagnetic radiation having a frequency lying within a certain frequency band, the method comprising the step of sheathing the wire with a layer of resonant structures.

26. The method of claim 25, wherein the step of sheathing the wire comprises the steps of:

(a) extruding the wire with at least one flat rib; and (b) swaging the at least flat rib to thereby form at least one resonant cavity between a surface of the rib and a core of the wire.

27. The method of claim 26, wherein the step of sheathing the wire further comprises the step of coating the surface of the ribs with a dielectric.

28. The method of claim 26, wherein the a least one flat rib has a generally circular shape before swaging.

29. The method of claim 26, wherein the at least one flat rib is, prior to swaging, a twisted flat rib forming a spiral surface wrapped around the wire in a threading-like fashion.

30. A method of making a wire essentially transparent to electromagnetic radiation, the electromagnetic radiation having a frequency lying within a certain frequency band, the method comprising the step of sheathing the wire with a layer of photonic band gap material.

31. A tunable reflector for reflecting an incident wave in a desired direction, the tunable reflector comprising a plurality of Hi-Z wires and a plurality of low impedance wires, the Hi-Z wires and the low impedance wires being disposed substantially parallel to one another in a grid, the Hi-Z wires having a resonance frequency, the incident wave having a frequency and a wavelength.

32. The tunable reflector of claim 31 wherein the grid is formed of alternating Hi-Z wires and low impedance wires, any two adjacent wires having a spacing therebetween, the spacing being substantially equal to half the wavelength of the incident wave.

33. The tunable reflector of claim 32, wherein the incident wave upon the tunable reflector has a reflection angle, the reflection angle being tunable by, either varying the resonance frequency of selected ones of the plurality of Hi-Z wires, or varying the frequency of the incident wave.

34. The tunable reflector of claim 33 further comprising a ground plane disposed substantially parallel to the grid, substantially one-quarter wavelength below the grid.

35. The tunable reflector of claim 31, wherein the Hi-Z wires and the low impedance wires are grouped in pairs, each pair comprising a Hi-Z wire and a low impedance wire disposed substantially parallel to one another, the pairs being disposed substantially parallel to one another in the grid, a spacing between two adjacent pairs being greater than a spacing between two wires forming a pair.

36. The tunable reflector of claim 35 further comprising a ground plane disposed substantially parallel to the grid, substantially one-quarter wavelength below the grid.

37. A method of steering a reflected incident wave, the reflected wave having a reflection angle, the incident wave having a frequency and a wavelength, the method comprising the steps of:

(a) disposing a plurality of Hi-Z wires and a plurality of low impedance wires in a grid, the wires being substantially parallel to one another, the Hi-Z wires having a resonance frequency; and (b) tuning the resonance frequency of selected ones of the Hi-Z wires and/or tuning the frequency of the incident wave, whereby to tune the reflection angle.

38. The method of claim 37, wherein the step of disposing the Hi-Z wires and the low impedance wires in a grid, includes the step of alternating Hi-Z and low impedance wires in the grid, any two adjacent wires having a spacing therebetween, the spacing being substantially equal to half the wavelength of the incident wave.

39. The method of claim 38, further comprising the steps of:

(a) providing a ground plane; and (b) disposing the ground plane substantially parallel to the grid, substantially one-quarter wavelength below the grid, whereby to eliminate a transmitted component of the incident wave.

40. The method of claim 39, wherein the step of disposing the Hi-Z wires and the low impedance wires in a grid, includes the step of grouping the Hi-Z wires and the low impedance wires in pairs, each pair comprising a Hi-Z wire and a low impedance wire, a spacing between two adjacent pairs being greater than a spacing between two wires forming a pair.

41. A method of selectively polarizing electromagnetic radiations of certain frequencies, the method comprising the steps of:

(a) providing a plurality of Hi-Z wires;

(b) disposing the plurality of Hi-Z wires in a generally parallel direction, thereby forming a grid.

42. The method of selectively polarizing electromagnetic radiations of certain frequencies as claimed in claim 41, wherein the Hi-Z wires have an outer surface comprising a layer of photonic band gap material.

* * * * *